US005531279A

United States Patent [19]

Biek

[11] Patent Number: 5,531,279

[45] Date of Patent: Jul. 2, 1996

[54] SENSOR IMPULSE UNIT

[75] Inventor: Paul A. Biek, Houston, Tex.

[73] Assignee: Indresco Inc., Dallas, Tex.

[21] Appl. No.: 226,810

[22] Filed: Apr. 12, 1994

[51] Int. Cl.[6] ..... B25B 19/00

[52] U.S. Cl. ..... 173/178; 173/93.5

[58] Field of Search ..... 173/93.5, 93.6, 173/93, 178, 176

[56] References Cited

U.S. PATENT DOCUMENTS

| | | | |
|---|---|---|---|
| 3,116,617 | 1/1964 | Skoog | 64/26 |
| 3,373,824 | 3/1968 | Whitehouse | 173/12 |
| 3,472,081 | 10/1969 | Keller et al. | 74/48 |
| 3,556,230 | 1/1971 | Roggenburk | 172/93.5 |
| 3,586,115 | 6/1971 | Amtsberg | 173/163 |
| 3,610,343 | 10/1971 | Bratt et al. | 173/12 |
| 3,643,749 | 2/1972 | Pauley | 173/93.5 |
| 3,696,871 | 10/1972 | Stenbacka | 173/12 |
| 3,739,659 | 6/1973 | Workman, Jr. | 74/751 |
| 3,809,179 | 5/1974 | Delaney, Jr. et al. | 181/36 |
| 3,871,138 | 3/1975 | Welsch | 51/170 |
| 4,120,604 | 10/1978 | Garofalo | 415/25 |
| 4,147,219 | 4/1979 | Wallace | 173/12 |
| 4,155,278 | 5/1979 | Estok | 81/57.11 |
| 4,266,444 | 5/1981 | Anderson et al. | 74/661 |
| 4,300,641 | 11/1981 | Kinkel | 173/12 |
| 4,307,784 | 12/1981 | Smith | 173/12 |
| 4,359,107 | 11/1982 | Smith | 173/12 |
| 4,434,858 | 3/1984 | Whitehouse | 173/12 |
| 4,462,282 | 7/1984 | Biek | 81/57.11 |
| 4,484,871 | 11/1984 | Adman et al. | 418/69 |
| 4,522,269 | 11/1985 | Adman et al. | 173/12 |
| 4,553,948 | 11/1985 | Tatsuno | 464/25 |
| 4,766,787 | 8/1988 | Sugimoto et al. | 81/463 |
| 4,789,373 | 12/1988 | Adman | 464/25 |
| 4,836,296 | 6/1989 | Biek | 173/93.5 |
| 4,844,177 | 7/1989 | Robinson et al. | 173/12 |
| 4,869,139 | 9/1989 | Gotman | 81/475 |
| 4,880,064 | 11/1989 | Willoughby et al. | 173/12 |
| 4,920,836 | 5/1990 | Sugimoto et al. | 173/93.5 |
| 4,991,473 | 2/1991 | Gotman | 81/475 |
| 5,080,181 | 1/1992 | Tatsuno | 173/93.5 |
| 5,092,410 | 3/1992 | Wallace et al. | 173/93.5 |
| 5,172,772 | 12/1992 | Kettner et al. | 173/93.5 |
| 5,181,575 | 1/1993 | Maruyama et al. | 173/180 |
| 5,203,242 | 4/1993 | Hansson | 81/469 |

FOREIGN PATENT DOCUMENTS

| | | |
|---|---|---|
| 0070325 | 1/1983 | European Pat. Off. . |
| 0638394 | 2/1995 | European Pat. Off. . |

OTHER PUBLICATIONS

*Atlas Copco* 1987 Catalog, "Industrial Power Tools" (five pages).

*Cleo* 1993 Catalog, "Cleco Air Tools" (four pages).

*Ingersoll–Rand* 1989 Catalog (four pages).

*Primary Examiner*—Scott A. Smith

*Attorney, Agent, or Firm*—Baker & Botts

[57] ABSTRACT

An impulse tool (20) having a housing (22), a motor (26), drive mechanism (30), impulse mechanism (28), trigger mechanism (67), and sensor (32) for automatic shut-off is disclosed. The sensor (32) uses a spring-biased ball (144) that sits on a ball seat (149) adjacent an entry orifice (108) and a spring-biased piston (112) such that when a predetermined non-transient torque is reached, the strength, duration and frequency of pulses of the working fluid entering the entry orifice (108) will lift the ball (144) sufficiently to impose on the piston (112) and to progressively lift the piston (112) to allow the working fluid to a triggering height which starts the shut-off of the impulse tool (20). A delay mechanism is also disclosed that may include a regulator (172), dashpot (170), spring latch (204), and trigger bar (56) or latch. A method of cooling an impulse tool with cold, dense air throughout is also disclosed.

18 Claims, 3 Drawing Sheets

SENSOR IMPULSE UNIT

TECHNICAL FIELD OF THE INVENTION

This invention relates generally to power tools, and more particularly, to impulse tools and sensors.

BACKGROUND OF THE INVENTION

Tools incorporating fluid-filled impulse units are known in the art; for example, a fluid pressure impulse nutrunner is disclosed in U.S. Pat. No. 4,836,296 to Biek. Some of the impulse units have included automatic shut-off devices, but these impulse units and shut-off devices have had numerous shortcomings.

One shortcoming may be that the impulse tool begins the shut-off process too early. For example, the tool may begin shut-off as the pulsing begins, which for a nutrunner or torque wrench frequently occurs after the initial phase of running the nut down loose threads. Other shut-off devices may cause the impulse unit to shut-off after a single blow of significant magnitude that may be in error because of complex inertial effects associated with the torsional drive train (spindle, socket, fastener, etc.). Similarly, the shut-off may be unreliable because of sensitivity to transient high pressure shock waves or pressure peaks that occur within liquid-filled impulse units during acceleration of initially non-rotating or slowly rotating components. Other shortcomings may include oil leakage, clogging of small orifices in the device, inadequate heat transfer away from the tool or device, high vibration, large size, and high noise levels. Further shortcomings may exist as these are but a few examples.

Therefore, a need has arisen for an improved impulse tool and improved shut-off device that will not shut off prematurely, that reduces oil leakage, that reduces vibration, that provides enhanced cooling, or that is capable of smaller sizing.

SUMMARY OF THE INVENTION

The present invention provides an impulse unit and shut-off sensor that eliminates or substantially reduces the shortcomings of the prior art. According to an aspect of the present invention an impulse tool is provided that may include a housing having an interior cavity and a plurality of openings, a motor disposed in the interior cavity, a drive means operable for coupling with a fastener and extending partially through one of the openings of the plurality of openings, an impulse means disposed in the cavity and coupled to the motor and drive means for generating a torque that urges the drive means to rotate, a trigger means for selectively activating the motor, and a sensor means coupled to the impulse means for shutting off the impulse tool when a predetermined non-transient torque is reached.

According to another aspect of the present invention a sensor is provided that may include a sensor body having a sensor cavity, an entry orifice, and a first piston opening, a piston disposed in the sensor cavity and a portion of the piston slidable within the first piston opening, a ball disposed in the sensor cavity between the piston and the entry orifice and sized to cover the entry orifice, a first spring means and a second spring means. The second spring means is coupled to the piston for urging the piston toward the entry orifice. The first spring means may be disposed between the piston and entry orifice for applying a force on the ball and impulse fluid. The impulse fluid may enter the sensor cavity with each pulse and sufficiently lift the piston when the predetermined non-transient torque is reached and thereby cause a portion of the piston to extend at least partially out of the sensor cavity through the first piston opening. According to another aspect of the present invention the sensor may have a channel formed on the sensor body adjacent to the orifice opening for allowing a bleeding or discharge of impulse fluid past the seated ball between pulses and when pulsing ceases.

According to another aspect of the present invention a delay means is provided that may include an air regulator, dashpot, and latching spring that in conjunction with an exhaust valve will shut off an impulse tool after a short delay once the delay means is triggered.

According to another aspect of the present invention a method for cooling an impulse tool is provided that may include the steps of allowing cool air to become pressurized during shut-off so that the tool is exposed to cool, dense air for a time period during shut-down and after shut-down.

Numerous technical advantages may be provided by the present invention. A few examples of the technical advantages include more reliable and consistent tightening, particularly when flexible and/or gasket type materials are included with a fastener assembly. Another technical advantage is that an impulse tool with a shut-off sensor according to the present invention may be conveniently sized to have a small overall length. Still another advantage is improved oil retention. A further advantage is a reduction in sensitivity to transient high pressures in the impulse fluid. A further advantage is a step-by-step progressive actuation of the sensor requiring several blows of sufficient strength, duration, and frequency that prevents premature shut-off of the tool. Finally, another technical advantage of the present invention is the ability to clear possible obstructions from bleed or discharge passages used as part of the system.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1–5 of the drawings, like numerals being used for like and corresponding parts of the various drawings.

The present invention relates to impulse tools and sensors for impulse tools, and may be used with any fluid-operated impulse tools. For the purposes of illustration, however, the invention is presented in the context of a fluid-operated torque impulse nutrunner. An example of an impulse nutrunner is shown in U.S. Pat. No. 4,836,296 to Biek, which is incorporated herein for all purposes.

Figure 1:
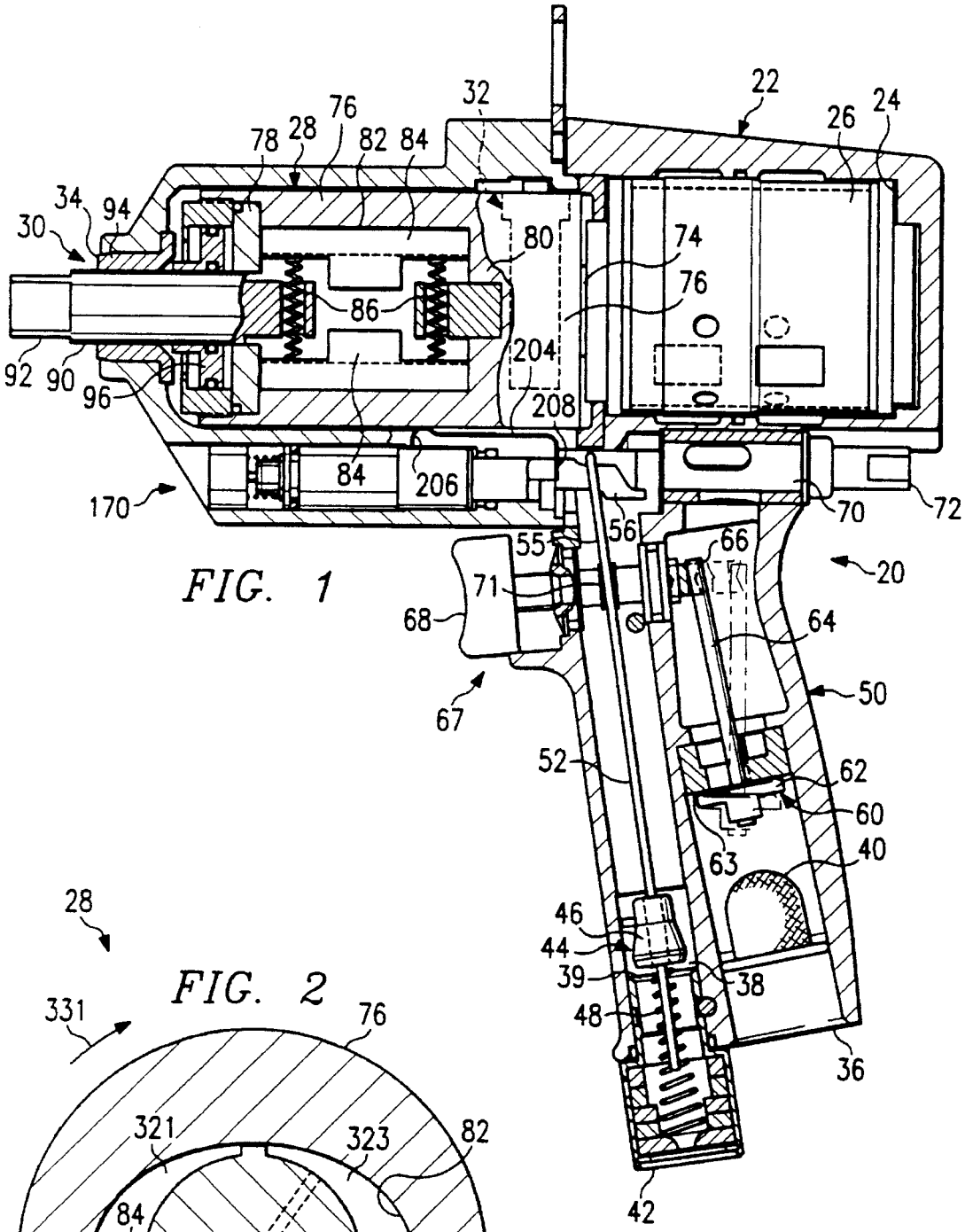
FIG. 1 is cross-sectional view with portions broken away of an impulse tool according to one aspect of the present invention.

Referring to FIG. 1, impulse tool 20 has a housing 22 with an interior housing cavity 24 formed therein. A pistol grip 50 may be formed as an integral part of housing 22. Motor 26, impulse means 28, at least a portion of drive means 30, and sensor means 32 may be disposed within cavity 24. A plurality of openings may be formed in housing 22 to provide access to cavity 24 or other portions of housing 22. For example, drive means opening 34 may be formed on a front section or first end of housing 22 to allow a portion of drive means 30 to extend therethrough. Other openings include air intake opening or orifice 36 and air exhaust opening or orifice 38. Impulse tool 20 preferably uses air as an operating fluid, but other types of operating fluid may be used with an impulse tool incorporating the present invention. Additionally, housing 22 may include a plurality of cooling passageways (not shown) for circulating cool air that exits air motor 26; circulating the exit air from motor 26 may enhance heat transfer from tool 20.

Air intake opening 36 allows air from a remote source (not shown) to enter impulse tool 20 while air exhaust opening 38 allows air to exit tool 20. Air intake opening 36 may be formed with an appropriate coupling to allow a pressurized air line (not shown) to be releasably secured to air intake opening 36. Other standard features such as a safety screen 40 may be included. Muffler and spring housing 42 may be secured adjacent to air exhaust opening 38. An exhaust shut-off valve or drop valve 44 may be associated with air exhaust opening 38 and muffler and spring housing 42.

Drop valve or exhaust valve 44 may have plunger 46 that is operable to seal or close opening 38. Plunger 46 is urged or biased towards valve seat 39 and opening 38 by air pressure when trigger means 67 is operated to allow air pressure to enter tool 20 through opening 36. Housing 22 includes cavity 24 and pistol grip 50 formed as an integral part thereof. A valve stem 52 is secured to plunger 46 such that when stem 52 is moved away from valve seat 39, plunger 46 unseats from valve seat 39, and valve 44 will be in the open position. When stem 52 is moved such that plunger 46 rests against valve seat 39, the valve will be in a shut or closed position, which allows only a small quantity of operating fluid or air by it. First end 55 of stem 52 interfaces with a trigger latch or bar 56, which is described in more detail in connection with FIGS. 4 and 5.

Air intake valve 60 controls the flow of operating fluid or air through air intake opening 36. Air intake valve 60 may have a sealing plate 62 with one portion 63 that allows sealing plate 62 to pivot under the influence of air intake valve stem 64 as shown in hidden lines in FIG. 1. An upper portion 66 of stem 64 interfaces with trigger means 67 (and may be a part of trigger means 67) to selectively allow the flow of air into tool 20.

Trigger means 67 also includes button 68 that may be depressed by an operator. Button 68 is linked to a first end of stem 64 to cause seal 62 to pivot as previously described. Channel 71 may be formed through the linkage of button 68 to allow first end 56 of drop valve stem 52 to pass therethrough. When button 68 or trigger means 67 is depressed, air or other operating fluid is allowed through opening 36 to energize or activate air motor 26, which depending on the position of forward/reverse selector 70 will cause motor 26 to run either forward or in reverse. Forward/reverse selector 70 has handle 72. Although, the embodiment described for illustrative purposes includes air motor 26, it is to be understood that one of the many alterations that may be made to the embodiment shown without departing from the spirit of the invention includes other types of motors or motive forces such as an electric motor or torsional driving spring.

Motor 26 may be coupled to impulse means 28 by coupling arrangement 74, which may be of a type known in the art. Similarly, impulse means 28 may be any fluid-filled impulse unit of a type known in the art such as the impulse unit shown in U.S. Pat. No. 4,836,296 to Biek. Impulse means 28 is filled with an impulse fluid such as an oil.

Impulse means 28 may include cage or impulse cage 76 and pressure plate 78 which form an impulse cavity 82. A plurality of blades 84 may be disposed in cavity 82 in opposed pairs that are urged radially outward by a plurality of springs 86. Impulse means 28 is coupled at one end by coupling means 74 to motor 26 and at the other end, or first end, to drive means 30. Blades 84 define a number of chambers in cavity 82 having pressure differentials created by the rotation of blades 84 that develop torque that is imparted to drive means 30.

Drive means 30 may include spindle 90 which may have coupled to a first end a square drive 92 for releasably attaching to or coupling to a fastener (not shown) that is to be tightened with impulse tool 20. The other end, or second end, of spindle 90 interfaces with impulse means 28, and more particularly with blades 84. Spindle 90 is supported in part by journal bearing 94.

Figure 2:
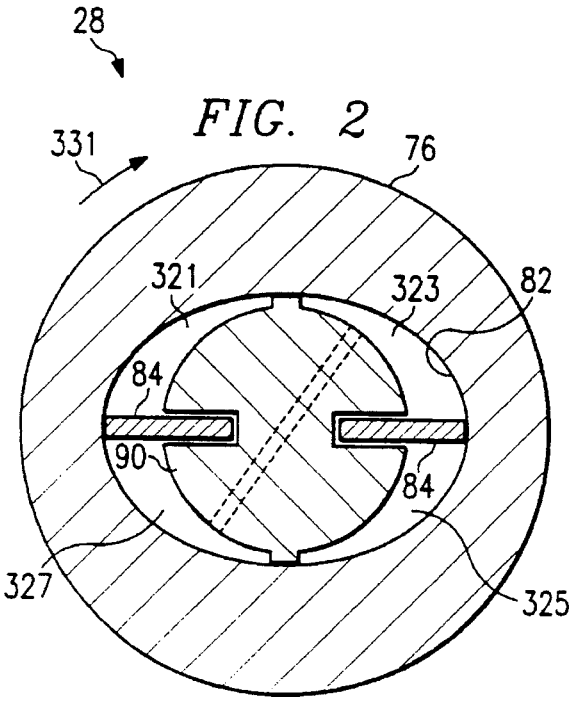
FIG. 2 is a schematic cross-sectional view of an impulse means.

Referring now to FIG. 2, a rough schematic of a cross-section of an impulse unit such as impulse means 28 is shown. Cavity 82, which is formed in cage 76, is shown with spindle 90 and blades 84 disposed in cavity 82. For the configuration and orientation shown in FIG. 2, impulse means 28 rotates in the direction of arrow 331. Cavity 82 is filled with an impulse fluid. During a pulse, cavity 327 and cavity 323, which are joined through a pulse spindle, are pressurized, i.e., are high pressure cavities. At the same time, cavities 321 and 325 are at a low pressure relative to cavities 323 and 327. Spindle 90 is thus caused to rotate. Cavity 327 may be placed in fluid communication with port 109 (FIG. 3) of sensor means 32 by drilling a hole through cage 76. Similarly, a machined passage within cage 76 may join cavity 323 to port 130 (FIG. 3) of sensor means 32.

Figure 3:
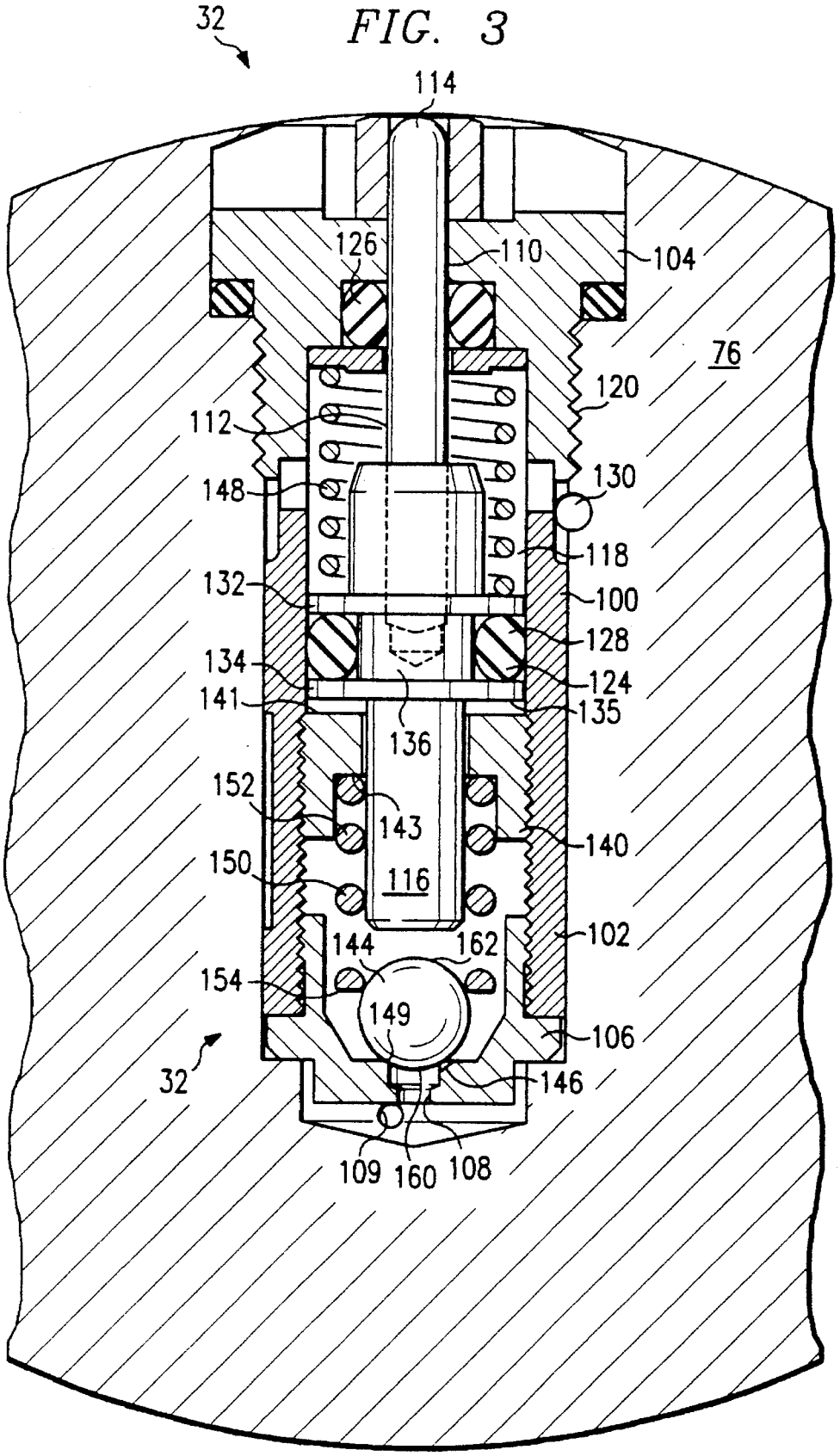
FIG. 3 is a partial cross-sectional view with portions broken away of one embodiment of a sensor means for the impulse tool of FIG. 1 according to an aspect of the present invention.

Sensor means 32 may be formed integral with or secured to cage 76. Sensor means 32 in the preferred embodiment will rotate with cage 76. Referring now to FIG. 3, an embodiment of sensor means 32 is shown. Sensor means 32 may include a sensor body 100 that may include sidewalls 102, first end cap 104 on a first end of sensor means 32, and a second end cap 106 on a second end of sensor means 32. Sensor body 100, and more particularly, second end cap 106, may have an entry orifice 108 formed therethrough. Entry orifice 108 is coupled through passageways to a high pressure chamber of impulse means 28, e.g., chamber 327 (FIG. 2) to allow the pressurized impulse fluid to flow into sensor means 32 through port 109 and into entry orifice 108. Entry orifice 108 is sized small enough in flow area that there is no significant effect on the output of pulse means 28; sensor means 32 does not operate as a relief valve.

In the preferred embodiment, entry orifice 108 is sized to have a 1/25 inch diameter. Sensor body 100 has a first piston opening 110. A sensor piston 112 having a first end 114 and a second end 116 is disposed within sensor cavity 118. A portion of piston 112 proximate first end 114 extends through first piston opening 110. First end cap 104 may have a threaded portion 120 for securing sensor means 32 within cage 76, and may be formed integral with or coupled by threads or other means to sidewalls 102. Likewise, second end cap 106 may be formed integral with or coupled to sidewall 102.

Piston 112 is movable within sensor means 32 as will be described below, and sealing means 124, 126, which may consist of a plurality of O-rings such as first O-ring 126 and second O-ring 128. O-ring 126 may prevent impulse fluid from exiting through first piston opening 110. A port 130 may be provided above second O-ring 128 to allow any impulse fluid displaced by piston 112 and O-ring 128 to return to a low pressure chamber or cavity, e.g., cavity 325 (FIG. 2) of impulse means 28. A first piston flange 132 and a second piston flange 134 may be attached to a mid-section 136 of piston 112, and sandwich O-ring 128 therebetween.

Disposed within sensor cavity 118 between mid-section 136 of piston 112 and entry orifice 108, is an adjustment collar 140, which is threaded along its periphery to mate with threads on the interior of sidewalls 102 to allow adjustment collar 140 to be adjusted with respect to the longitudinal axis of sensor means 32. A ball or puppet valve 144 is placed in cavity 118 between adjustment collar 140 and entry orifice 108. Ball 144 is sized to substantially cover ball seat 149. Groove 146 is formed in second end cap 106 on ball seat 149. Sensor means 32 may include a first spring means 150 which urges ball 144 towards ball seat 149, and a second spring means 148 which urges piston 112 towards ball seat 149. Adjustment collar 140 is operable to adjust the compression of the spring means 150 as will be described in more detail below.

Second spring means 148 is disposed between first piston opening 110 of first end cap 104 and first piston flange 132. Second spring 148 is in compression, and thus exerts a force on flange 132 that urges the piston towards orifice 108. A first spring 150 is disposed between adjustable collar 140 and ball 144. Spring 150 has a first end 152, which rests against adjustment collar 140, and a second end 154 which rests against ball 144. First spring 150 urges ball 144 against ball seat 149 and channel 146. Adjustment collar 140 has a top surface 141 and a bottom surface 143. When adjustment collar 140 is moved, it adjusts the compression in first spring 150. Second spring 148 is a return spring to bias piston 112 toward orifice 108.

Groove or channel 146 is formed in second end cap 106 adjacent to entry orifice 108. Channel 146 allows discharge of impulse fluid from sensor cavity 118 at a controlled rate by allowing flow around ball 144 while ball 144 is seated on ball seat 149. This discharge occurs between pulse blows and when the tool is automatically re-setting for the next cycle. In the preferred embodiment, channel 146 is used to provide a controlled rate of flow because if a separate small orifice, e.g., 4/1000, were to be used, it would most likely become plugged with debris. Channel 146 is self-cleansing and will be flushed clean as impulse fluid lifts ball 144 and flows around ball 144 during a forward pressure pulse. This is an important aspect of the present invention as without it very small debris could possibly shut-down operation of sensor means 32; for example, a microscopic portion of a gasket or other debris produced only from wear could otherwise be enough to impede normal operation of sensor means 32.

In operation, impulse fluid from chamber 327 of impulse means 28 is directed through port 109 and orifice 108, and a resultant pressure is applied to a second portion 160 of ball 144. As a sufficient pressure develops against second portion 160 of ball 144, first spring 150 becomes more compressed, and ball 144 is lifted from ball seat 149 and channel or groove 146. If the impulse pressure through orifice 108 is a transient high pressure or has not yet reached a sufficient pressure (that is indicative of a desired predetermined non-transient torque), ball 144 is quickly returned at the end of the pulse to its seat on channel 146 by spring means 150. As the strength of each pulse increases, a larger flow of impulse fluid will pass between seat 149 and ball 144, and the building pressure against flange 134 of piston 112 will move piston 112 a greater distance towards opening 110 as the fluid bears against O-ring 124. Spring 148 may, however, still return piston 112 to the position illustrated in FIG. 3 by bleeding (discharging) fluid through channel 146 before the next blow occurs. To sense a tightened fastener, multiple pulses of sufficient pressure, duration, and frequency must by delivered to allow piston 112 to move towards opening 110 in a progressive fashion. If the movement of piston 112 towards opening 110 on a single pulse is greater than the movement back towards orifice 108 during discharge through metering channel 146, there is a net movement of piston 112 toward opening 110 at the instant the next pulse occurs. This can continue in a progressive fashion until end 114 of piston 112 extends sufficiently beyond case 76 and the sensor 32 initiates shut off of tool 20.

Impulse cage 76 is rotating as tool 20 is operated such that when first end 114 extends sufficiently beyond the outer diameter of cage 76, first end 114 will make contact with a portion (e.g., latch 204 of FIG. 1) of a shut-off means that initiates the shut off of tool 20. The force developed by spring means 150 may be adjusted by adjustment collar 140 such that first end 114 extends sufficiently beyond the outer diameter of cage 76 only when multiple pulses of a strength, duration and frequency that are indicative of predetermined non-transient torque being reached on the fastener being tightened. The process of biasing ball 144 with spring means 150 and requiring fluid pressure to lift piston 112 in a progressive fashion with multiple pulses prevents transient high pressures from causing first end 114 to extend sufficiently beyond cage 76 prematurely. It should be noted that the embodiment of sensor 32 shown in FIG. 3 allows for a coaxial sensor means 32, and sensor means 32 may be mounted radially within tool 20 in conjunction with down-handle exhaust drop valve 44 shut-off to allow tool 20 to be manufactured with a shorter length than otherwise possible.

Once sensor means 32 is exposed to several pulses of sufficient strength, duration, and frequency, a shut-off means is triggered. The shut-off means may take numerous forms, but one embodiment is shown in tool 20 of FIG. 1. The shut-off means may include a dashpot such as an oil-filled dashpot 170, an air regulator 172 (FIG. 4), and a valve closing means, which may include a trigger latch or bar 56, a valve stem 52, and an exhaust valve 44.

Figure 4:
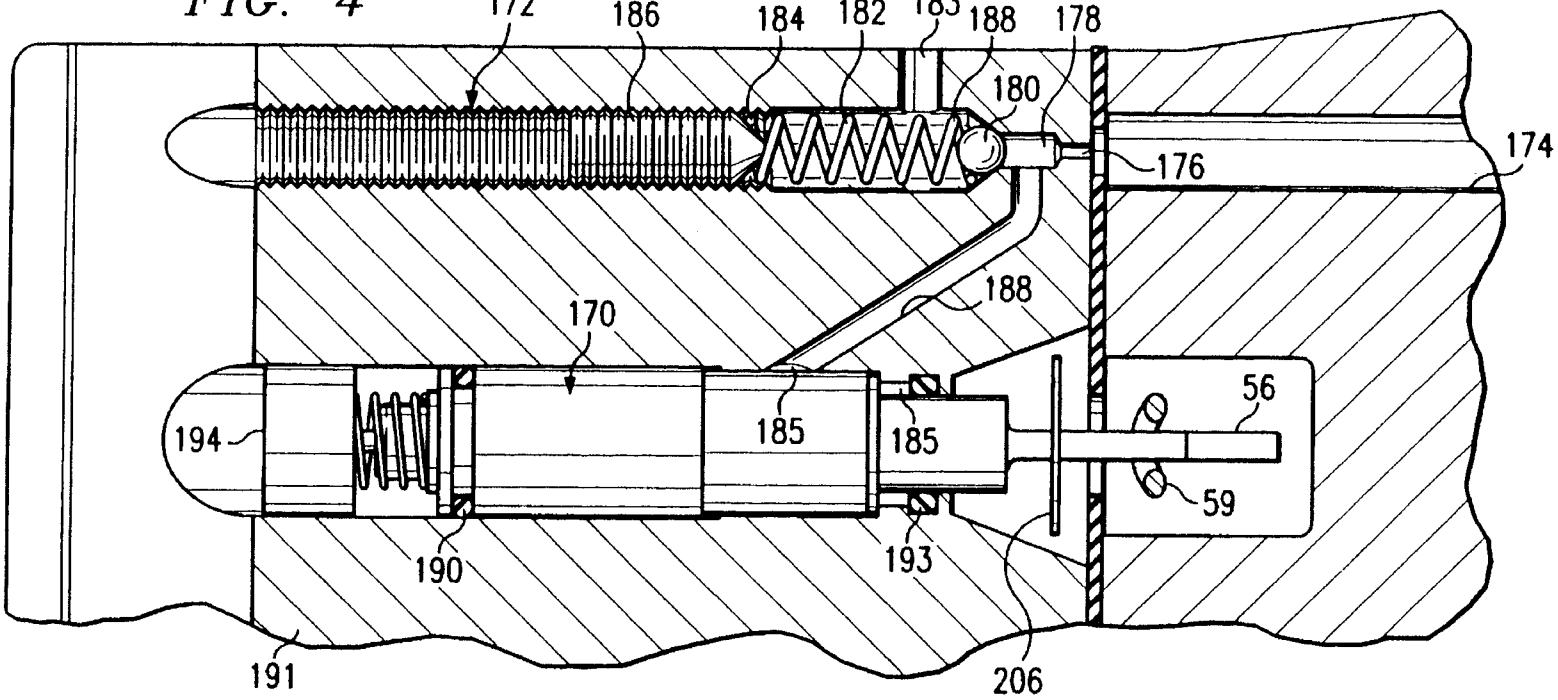
FIG. 4 is a partial cross-sectional view with portions broken away showing one embodiment of a delay means for the impulse tool of FIG. 1 according to an aspect of the present invention.

Referring now to FIG. 4, a portion of the shut-off means is shown; particularly, air regulator 172 and dashpot 170 are shown. When trigger means 67 is activated such that air is supplied to tool 20, air is simultaneously provided to motor 26 and to air regulator 172. Air supplied to air regulator 172 arrives through an air passageway 174 that is formed in housing 22 of tool 20. Air arriving through passage 174 passes through orifice or choke 176 and into cavity 178. Pressure in cavity 178 is regulated by allowing excess air to pass a spring-biased ball 180, which is biased by spring 182. A first portion 184 of spring 182 pushes against a regulator adjustment cap 186, and a second end 188 of spring 182 pushes against ball 180.

When excess air pressure unseats ball 180, air is vented to atmosphere through an aperture 183. The regulated air (as opposed to the excess air) exiting cavity 178 travels through passage 189 toward dashpot 170 where it builds the pressure between a first O-ring 190 and a second O-ring 193. The air between O-rings 190 and 193 provides a pressure which urges dashpot 170 to move towards first end 194 which in turn urges trigger latch or bar 56 in the same direction. When trigger bar 56 is allowed to move under the influence of dashpot 170, it will eventually allow stem 52 to drop, which closes valve 44 and shuts off tool 20.

Figure 5:
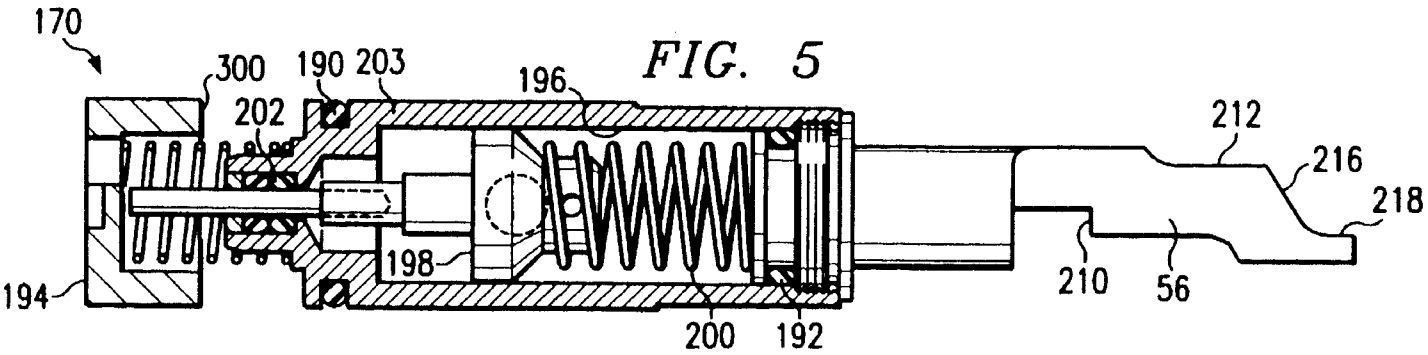
FIG. 5 is a cross-sectional view with portions broken away of a dashpot and trigger bar for the impulse tool of FIG. 1 according to an aspect of the present invention.

Referring now to FIGS. 4 and 5, one embodiment of dashpot 170 is presented. Air from passage 188 is delivered into cavity 185 between O-ring 193 and O-ring 190. Dashpot 170 has a dashpot housing 203 as the pressure builds in cavity 185, the dashpot housing 203 and attached bar 56 are urged toward the stationary end cap 194. A spring 200 may also be included in cavity 196. A plurality of O-rings 202 may be provided to prevent dashpot oil from leaking out of oil-filled dashpot 170.

A latch spring 204 may be coupled to a portion of dashpot housing 203 (see FIG. 1). Latch spring 204 controls the position of dashpot 170. Dashpot 170 is configured to have primarily two positions: a first position in which dashpot housing 203 is spaced from wall 300 and in which valve 44 is maintained open, and a second position in which dashpot housing 203 is adjacent to wall 300 and in which valve 44 is allowed to close.

Dashpot 170 is held in the first position by latch spring 204 (FIG. 1). A first end 206 of latch spring 204 is coupled to housing portion 191. A second end 208 of latch spring 204 is releasably coupled to shoulder 210 on trigger bar 56 to hold dashpot 170 in the first position. In the first position, latch spring 204 will not allow dashpot 170 to move towards first end 194 as it is being urged to do so by pressure in cavity 185. Also, while in this first position, valve 44 is held open by stem 52, which has an aperture 59 (FIG. 4) on first end 55 that rests on an upper shoulder 212 of trigger bar 56.

When the sensor means 32 senses pulses of sufficient strength, duration, and frequency, the first end 114 extends a sufficient distance beyond the outer diameter of cage 76, and first end 114 of piston 112 comes into contact with spring latch 204 and frees it such that dashpot 170 may move towards first end 194 as previously described. Second end 208 of latch 204 may have an aperture through it for allowing bar 56 to pass so that shoulder 210 is securely held by latch spring 204. When latch spring 204 is contacted by piston 112 of sensor means 32, the force causes second end 208 of spring latch 204 to move off shoulder 210, which releases dashpot 170. Thus, dashpot 170 goes from the first position to the second position. In the second position, opening 59 of stem 52 moves from shoulder 212 down angled portion 216 of bar 56 and comes to rest on portion 218. As aperture 59 moves to portion 218, stem 52 moves towards exhaust opening 38, and allows plunger or sealing plate 46 to substantially seat on valve seat 39 and thereby close valve 44. Once valve 44 is closed, the interior, including cavity 24, of tool 20 develops a uniform pressure that stops motor 26 and shuts off tool 20. Shutting off tool 20 in this manner may provide enhanced cooling of tool 20 as described in more detail below. After shut-off, valve 44 may allow a slow bleed or flow of air out of opening 38.

As another aspect of the present invention, a cool, dense fluid may be used to cool tool 20. The fluid may be a compressible fluid such as air. The cool, dense air that cools tool 20 is produced by the cool or refrigerated air exiting motor 26 being held within tool 20 after tool 20 has shut off by closing valve 44. By closing valve 44, the pressure of the air within tool 20 builds significantly which increases the density of the air which in turn facilitates heat transfer from tool 20 to the cool air. For example, without shut-off valve 44 configured as it is shown in the preferred embodiment, the cool air exiting motor 26 may be exposed to the internal components of tool 20 with only a pressure of approximately 20–25 psi, but in the preferred embodiment, the closing of valve 44 causes the pressure of the cool air to build to somewhere around 90 psi for the embodiment shown. This increase in pressure (and thus density) significantly enhances the thermodynamic characteristics of the air and allows for increased heat transfer. Once the button 68 is released by the operator, the intake valve 60 closes, the cool air inside tool 20 flows past the partial seal of valve 44 or elsewhere, the exhaust valve 44 opens, and latch spring 204 resets with respect to shoulder 210. Tool 20 is then ready for another cycle. In an alternative embodiment, a delay mechanism may be provided such that when the operator releases button 68, an additional time period of delay will occur before valve 44 is reset. Thus allowing additional cooling time for the cool, dense air exposed to interior, e.g., cavity 24.

The basic steps involved in operating tool 20 of FIGS. 1–5, include the operator placing square drive 92 of tool 20 on the fastener that is to be tightened. The operator then depresses button 68 of trigger means 67 which opens air intake valve 60, which provides a pressurized air supply to motor 26 and air regulator 172. The pressurized air supplied to motor 26 energizes motor 26 to run in either a forward or reverse direction according to the input of forward/reverse selector 70 as controlled by handle 72. Motor 26, which is driven by the air supply, causes impulse means 28 to begin operation, which includes developing a torque that is transmitted to drive means 30. Drive means 30 rotates square drive 92 which either removes or tightens the fastener according to the direction of rotation.

In the tightening direction, the sensor means 32 has been adjusted for a predetermined torque condition so when the strength, duration and frequency correspond to the torque, the sensor will trigger shut-down. When impulse fluid from a high pressure chamber of impulse means 28 enters port 109 and entry orifice 108, it applies a pressure against ball 144. When the frequency of pulses and the pressure of the impulse fluid entering entry orifice 108 increases sufficiently, impulse fluid flow will cause piston 112 to move away from orifice 108 in a progressive movement to where first end 114 extends sufficiently beyond an outer diameter of cage 76. Because cage 76 is rotating, first end 114 of piston 112 will rotate and come into contact with latch spring 204 and release it.

Once latch spring 204 is released, dashpot 170 is free to move under the influence of a pressure that has been supplied into cavity 185 from air regulator 172. Dashpot 170 moves bar 56 in a direction that causes first end 55 of stem 52 which is in contact with bar 56, to move towards air exhaust opening 38 causing plunger 46 to seal off valve seat 39, which closes valve 44. When valve 44 closes, the tool 20 becomes isobaric or develops a uniform pressure throughout that stalls the operation of motor 26 and thus shuts off tool 20. The operator may then release button 68 which allows valve 60 to close, valve 44 to open, and latch spring 204 to reset on shoulder 210 such that tool 20 is again ready for operation.

As an aspect of the operation, the air exiting motor 26 may be a cool air that increases in density when valve 44 is shut which enhances cooling. Before button 68 is released, the cool, dense air helps to cool the internal components. After button 68 is released, cool air flows around impulse means 28 and exits at valve 44 or elsewhere. As an alternative embodiment, a delay means may be added that delays the closing of valve 60 and the opening of valve 44 after button 68 is released to provide additional time during which the internal components of tool 20 are exposed to the cool, dense air.

Although the present invention and its advantages have been described in detail, it should be understood that various changes, substitutions and alterations can be made therein without departing from the spirit and scope of the invention as defined by the appended claims.

What is claimed is:

1. An impulse tool comprising:

a housing having an interior housing cavity and a plurality of openings;

a motor disposed in the interior housing cavity;

a drive means for coupling to a fastener and the drive means extending partially through one of the plurality of openings;

an fluid-filled impulse means containing an impulse fluid and disposed in the housing cavity and coupled to the motor and drive means for generating a torque urging the drive means to rotate;

a trigger means for selectively activating the motor;

a shut-off means for shutting of the tool once the shut-off means is activated;

a sensor means coupled to the impulse means for activating the shut-off means when a predetermined non-transient torque is reached; and wherein the sensor means comprises:

a sensor body having a sensor cavity, an entry orifice, and a first piston opening, the entry orifice in fluid communication with the impulse fluid of the impulse means;

a ball sized to cover the entry orifice;

a piston disposed in the sensor cavity having a first end and a second end, the first end slidably disposed in a portion of the first piston opening;

a first spring means for developing a force urging the ball toward the entry orifice;

a second spring means for urging the piston towards the entry orifice;

an adjustment means for adjusting the force developed by the first spring means to select the predetermined non-transient torque; and the first spring means urges the ball towards the entry orifice such that only when a predetermined non-transient torque is reached will the energy of the impulse fluid allowed to enter the sensor cavity be capable of moving the piston to where the piston sufficiently extends beyond an outer portion of the sensor body and triggers shut-down of the impulse tool.

2. The impulse tool of claim 1 wherein the adjustment means comprises an adjustment collar disposed in the sensor cavity having a second piston opening therethrough, a mid-section of the piston extending through the second piston opening and slidable therein, the adjustment means for adjusting the compression of the first spring means allow the piston to extend beyond the outer portion of the first piston opening when the predetermined non-transient torque is reached.

3. The impulse tool of claim 1, wherein the entry orifice, the first piston opening, and the piston are substantially coaxial.

4. The impulse tool of claim 1, further comprising:

a ball seat formed on the sensor body proximate the entry orifice; and a channel formed on the ball seat and allowing fluid to clear the channel of any debris that might be clogged.

5. The impulse tool of claim 1, further comprising a sensor sealing means for preventing fluid from leaking from impulse means comprises a plurality of O-rings.

6. The impulse tool of claim 5, wherein the sensor sealing means comprises a plurality of O-rings.

7. The impulse tool of claim 1, wherein the sensor body further comprises a threaded portion for sealingly and releasably attaching the sensor to the impulse means.

8. The impulse tool of claim 1, wherein the shut-off means causes a delay between the time when the sensor means senses the predetermined non-transient torque and when the tool shuts off.

9. The impulse tool of claim 8, wherein the shut-off means further comprises an air regulating means for causing a uniform time delay substantially unaffected by variations in supply pressure to the air tool.

10. The impulse tool of claim 8, wherein the shut-off means comprises:

an air regulator for providing air pressure at a pressure less than or equal to a known pressure;

a spring latch having a first end and a second end;

a dashpot having a first position and a second position, the first end of the spring latch attached to the dashpot;

a valve closing means coupled to the dashpot such that movement of the dashpot from the dashpot's first position to the dashpot's second position causes the valve closing means to shut off the impulse tool, the second end of the spring latch releasably attached to the valve closing means; and the spring latch positioned so that when the sensor means causes the first end of the piston to extend beyond the sensor body, the first end of the piston will contact the spring latch and remove it from engagement with the spring closing means and thereby allows the dashpot to go to the dashpot's second position causing the tool to shut off.

11. The impulse tool of claim 1, wherein the sensor means comprises:

a sensor body having a sensor cavity, an entry orifice, and a first piston opening, the entry orifice in fluid communication with the impulse fluid of the impulse means;

a ball sized to cover the entry orifice and disposed within the sensor cavity;

a piston disposed in the sensor cavity having a first end and a second end, the first end slidably disposed in a portion of the first piston opening;

an adjustment collar disposed in the sensor cavity having a second piston opening therethrough, a mid-section of the piston extending through the adjustment collar and slidable therein;

a first spring disposed in the sensor cavity between the adjustment collar and the ball for urging the ball toward the entry orifice with a first force;

a second spring disposed between the piston opening and the adjustment collar for urging the piston toward the entry orifice with a second force; and the adjustment collar for adjusting first sensor spring to select a first force such that when several pulses indicative of a predetermined non-transient torque are reached, the impulse fluid will lift the ball and move the piston in a step-by-step progressive manner until the first end of the piston extends sufficiently beyond the piston opening.

12. The impulse tool of claim 11, wherein the entry orifice, the first piston opening, and the piston are substantially coaxial.

13. The impulse tool of claim 11, wherein the sealing means comprises a plurality of O-rings.

14. The impulse tool of claim 11, wherein the sensor body further comprises a threaded portion for sealingly and releasably attaching the sensor to the impulse means.

15. The impulse tool of claim 14, wherein the shut-off means further comprises:

an exhaust orifice formed in one opening of the plurality of openings in the housing;

a drop valve seated proximate the exhaust orifice for opening and closing the exhaust orifice;

a stem coupled to the drop valve and coupled to the valve closing means such that when the dashpot moves to the dashpot's second position the stem closes the drop valve.

16. The impulse tool of claim 11, wherein the shut-off means comprises:

an air regulator means for providing air pressure at a pressure less than or equal to a known pressure;

a spring latch having a first end and a second end, the second end of the spring latch attached to the housing;

a dashpot having a first position and a second position, the first end of the spring latch releasably attached to the dashpot;

a valve closing means coupled to the dashpot such that movement of the dashpot from the dashpot's first position to the dashpot's second position causes the valve closing means to shut off the impulse tool; and the spring latch positioned so that when the sensor means causes the first end of the piston to extend sufficiently beyond the sensor body, the first end of the piston will contact the spring latch and remove it from engagement with the dashpot and allow the dashpot to go to the dashpot's second position thereby causing the tool to shut off.

17. The impulse tool of claim 16, wherein the motor is an air-operated motor.

18. An impulse tool for providing torque to a fastener, the tool comprising:

a housing having an interior housing cavity and a plurality of openings;

an air-operated motor disposed in the interior housing cavity;

a drive means for releasably coupling to a fastener to provide a torque to the fastener, the drive means extending partially through one of the plurality of openings in the housing;

a fluid-filled impulse means disposed in the housing cavity and coupled to the motor and drive means for generating a torque that urges the drive means to rotate, thereby providing a torque to the fastener, the impulse means containing an impulse fluid;

a shut-off means;

a trigger means attached to the tool for selectively activating the motor;

a sensor means in fluid communication with the impulse fluid of the impulse means for shutting off the impulse tool when a predetermined non-transient torque is reached, the sensor means comprising:

a sensor body having a sensor cavity, an entry orifice, a ball seat and a first piston opening, the entry orifice in fluid communication with the impulse means, a ball sized to cover the entry orifice, a piston disposed in the sensor cavity having a first end and a second end, the first end slidably disposed in a portion of the first piston opening, a first sensor spring for urging the ball toward the entry orifice, a second sensor spring for urging the piston toward the entry orifice, an adjustment collar disposed in the sensor cavity having a second piston opening therethrough, a mid-section of the piston extending through the adjustment collar and slidable therein, the adjustment collar for adjusting the first spring means, a sensor seal means for preventing impulse fluid entering the sensor from leaking, and the ball seated on the entry orifice by the first spring such that when the predetermined non-transient pressure, which is indicative of the predetermined non-transient torque, is reached, the energy of the impulse fluid entering the entry orifice will lift the ball which moves the piston in a progressive manner until the first end of the piston extends sufficiently beyond an outer portion of the sensor body and triggers a shut-off means; and the shut-off means comprising:

an air regulator for providing air pressure at a pressure less than or equal to a known pressure, a spring latch having a first and second end, a valve closing means, a dashpot having a first position and a second position, the second end of the spring latch coupled to the dashpot and the first end of the spring latch releasably attached to the valve closing means, the valve closing means coupled to the dashpot such that movement of the dashpot to the dashpot's second position causes the valve closing means to shut off the impulse tool, and the spring latch positioned so that when the sensor means causes the first end of the piston to extend beyond the sensor body, the first end of the piston will contact the spring latch and remove it from engagement with the dashpot causing the dashpot to go to the dashpot's second position.

* * * * *